United States Patent [19]

Kasajima et al.

[11] 4,196,410

[45] Apr. 1, 1980

[54] VARIABLE RESISTOR

[75] Inventors: Masao Kasajima; Kozo Magami, both of Miyagi, Japan

[73] Assignee: Alps Electric Co., Ltd., Tokyo, Japan

[21] Appl. No.: 874,014

[22] Filed: Jan. 31, 1978

[30] Foreign Application Priority Data

Feb. 3, 1977 [JP] Japan ..... 52-12126[U]

[51] Int. Cl.[2] ..... H01C 10/46

[52] U.S. Cl. ..... 338/185; 338/174; 338/325; 338/188; 338/190

[58] Field of Search ..... 338/174, 175, 171, 125–128, 338/160, 162, 185, 188, 190, 307, 308, 314, 322–325, 328, 334

[56] References Cited

U.S. PATENT DOCUMENTS

| | | | |
|---|---|---|---|
| 2,269,136 | 1/1942 | Tellkamp | 338/172 |
| 3,898,606 | 8/1975 | Dumas et al. | 338/48 |

*Primary Examiner*—C. L. Albritton

*Attorney, Agent, or Firm*—Guy W. Shoup; Gerard F. Dunne

[57] ABSTRACT

A compact variable resistor adapted for use in balance adjusting circuits for stereo tape players or the like has an insulating substrate plate, lead conductor, insulating film and a resistance body. The lead conductor is connected to the resistance body through a central tap conductor provided at the central portion of the resistance body. The portions of the lead conductor other than the central conductor are insulated from the resistance body by the insulating film.

5 Claims, 6 Drawing Figures

VARIABLE RESISTOR

BACKGROUND OF THE INVENTION

The present invention relates to variable resistors and, more particularly, to a balance adjusting variable resistor which is compact and, therefore, is suitable for use in such devices as stereo tape players for use in automobiles.

In conventional variable resistors of the type described, a resistance body 6 of a generally horseshoe shape is formed, as shown in FIGS. 1 and 2, on an insulating substrate plate 5, in such a manner that the two ends of the resistance body 6 are connected to terminals 1 and 3 through respective conductive portions 7 and 8. A tap terminal 4 is provided, through a central tap conductor 4', at an intermediate or central portion of the path of a slide 10 which is adapted to slide on the resistance body 6. Alternatively, as shown in FIG. 2, the tap terminal 4 is arranged in side-by-side relation with other terminals, and connected to the intermediate portion of the resistance body through a metal strip 4a. A left and right balance adjusting circuit as shown diagrammatically in FIG. 3, can be formed by grounding the tap terminal by, for example, connecting it to the intermediate terminal 2 through a lead wire.

In the conventional variable resistors having the above described structure, it is quite inconvenient that the variable resistor must have a space for providing the tap terminal 4 at the intermediate portion of the resistance body 6, so that the variable resistor is rendered generally unsuitable for use where a smaller size of the resistor is specifically required, such as in stereo tape players suitable for use in motor vehicles. In addition, conventional variable resistors of the type described employ an undesirably large number of components and are difficult to assemble.

It is therefore an object of the present invention to provide a variable resistor for balance adjustment, which is small in size and easy to assemble, thereby to overcome the above described problems of the prior art.

SUMMARY OF THE INVENTION

To this end, according to the present invention, there is provided a variable resistor in which a lead conductor, insulating film and resistance body are formed in sequence on an insulating substrate plate. The lead conductor is connected to the resistance body through a central tap conductor positioned at the center of the resistance body and the portions of the lead conductor other than the tap conductor are insulated from the resistance body by the insulating film.

DETAILED DESCRIPTION OF THE PREFERRED EMBODIMENT

Figure 4:
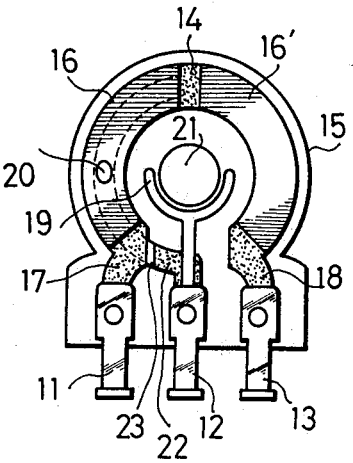
FIG. 4 is a plan view of a variable resistor of the present invention.
Figure 5:
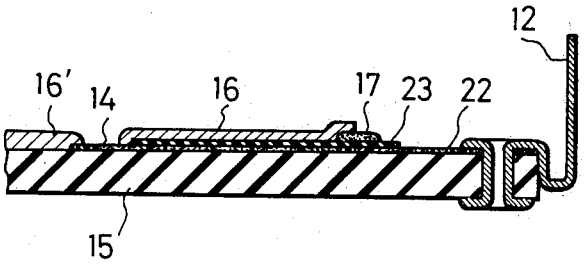
FIG. 5 is a sectional view of the variable resistor of FIG. 4.

Referring to FIGS. 4 and 5 showing a preferred embodiment of the present invention, an arcuate split resistance body is provided on an insulating substrate plate 15 by means of, for example, printing. Ends of the resistance body are connected to terminals 11 and 13 through conductive portions 17 and 18, respectively. A collecting body 19 is connected to an intermediate terminal 12 and is slidingly contacted by a slide 20 having a contactor portion thereof adapted to engage the resistance body. Numeral 21 denotes a shaft bore.

The variable resistor of the present invention as stated above is manufactured by the following steps of process.

At first, an arcuate generally semi-circular lead conductor 22 which leads generally along the outer portions of the substrate plate 15 from the intermediate terminal 12 to the central portion of the substrate plate outer portion, as well as a central tap conductor 14 is formed. Then, an insulating film 23 of a suitable synthetic plastics or the like material is formed to cover portions of the lead conductor 22 except the area about the terminal 12 and the central tap conductor 14.

Subsequently, a conductive portion 17 connected to the terminal 11 is formed on an end portion of the insulating film 23, while a conductive portion 18 communicating with the terminal 13 is formed on the insulating substrate plate 15.

Finally, a resistance body portion 16 is formed so as to interconnect the conductive portion 17 and the central tap conductor 14, while another resistance body portion 16' is formed to interconnect the central tap conductor 14 and the conductive portion 18.

Figure 1:
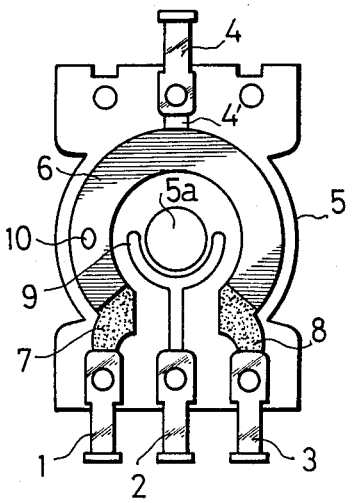
Fig. 1 PRIOR ART
FIGS. 1 and 2 are plan views of conventional variable resistors.
Figure 3:
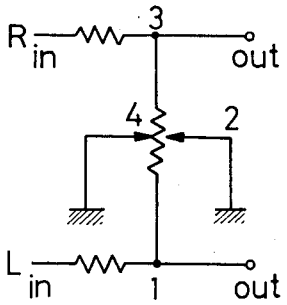
FIG. 3 diagrammatically shows a balance adjusting circuit.
Figure 2:
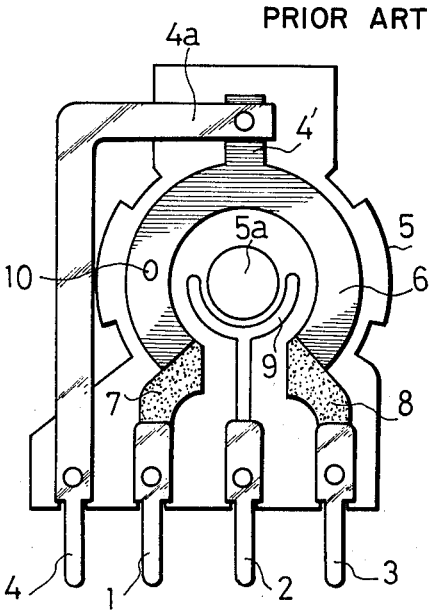
Fig. 2 PRIOR ART

In this way, a compact left and right balance adjusting circuit, such as that shown diagrammatically in FIG. 3, is formed, for the central tap conductor 14 is grounded through the lead conductor 22 to the intermediate termianl 12. Further, no additional leads running exteriorly of the resistor are necessary for grounding the tap conductor 14.

Figure 6:
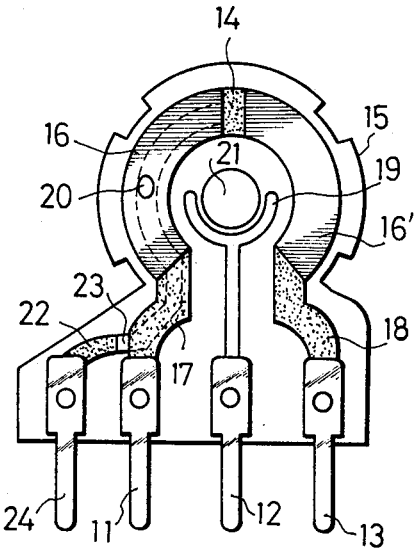
FIG. 6 is a plan view of another embodiment of the present invention.

FIG. 6 shows another embodiment of the present invention. A tap terminal 24 is provided in side-by-side relation with the terminal 11, while one end portion of the lead conductor 22 is connected to the tap terminal 24 instead of the intermediate terminal 12. For this embodiment, a compact left and right balance adjusting circuit, such as that shown diagrammatically in FIG. 3, can be provided by grounding the tap terminal by, for example, connecting it to the intermediate terminal 12.

Thus, in a variable resistor according to the present invention, the resistance body is connected to the central tap conductor 14 provided at the central or mid point of the resistance body, while a lead conductor 22 is formed so as to be insulated from the overlying portions of the resistance body, the lead conductor 22 being connected directly to the intermediate terminal or to a separately provided tap terminal.

It will be seen that a plurality of terminals can be disposed at one side of the insulating substrate plate, so that the outer diameter of the latter can be conveniently diminished. In addition, the number of parts is reduced because the metal strip for connecting the central tap conductor to the tap terminal in the prior art can be dispensed with, so that the assembling and wiring of the balance adjusting variable resistor are greatly facilitated.

It will be seen that the resistance body need not always be split into two halves, but a continuous resistance body may be formed on the central conductor 14, without deteriorating from the advantages of the present invention.

In addition, the present invention can be applied not only to the described rotary type resistors but to linear slide types as well.

What is claimed is:

1. A variable resistor suitable for use in a balance control circuit, comprising a substrate plate formed from an electrically insulating material;

an elongate resistance body carried by said substrate plate;

an elongate conductor applied on the surface of said substrate plate and underlying generally half the length of said resistance body, said conductor having a first end portion contacting the approximate central portion of said resistance body, a second end portion and an intermediate portion interconnecting said first and second end portions;

a film of electrically insulating material extending between the intermediate portion of said conductor and the portion of said resistance body lying thereover;

first and second terminals electrically connected, respectively, to end portions of said resistance body; and a slide slidably contacting a collector connected electrically to a third terminal and including a contactor adapted to slidably engage said resistance body.

2. A resistor according to claim 1, the second end portion of said conductor being connected electrically to said third terminal whereby said central portion of said resistance body will be continually connected electrically to said third terminal.

3. A resistor according to claim 1, including a fourth terminal, said second end portion of said conductor being connected electrically to said fourth terminal.

4. A variable resistor according to claim 2, said resistance body being constituted by two similar resistance body portions having adjacent end portions forming the central portion of said resistance body; said resistance body portions extending, respectively, to said first and second terminals.

5. A variable resistor according to claim 3, said resistance body being constituted by two similar resistance body portions having adjacent end portions forming the central portion of said resistance body; said resistance body portions extending respectively to said first and second terminals.

* * * * *